US008667898B2

(12) United States Patent
Checketts et al.

(10) Patent No.: US 8,667,898 B2
(45) Date of Patent: Mar. 11, 2014

(54) AMUSEMENT RIDE LOAD AND UNLOAD METHOD AND ASSOCIATED APPARATUS

(76) Inventors: Stanley J. Checketts, Providence, UT (US); Val Simmons, Providence, UT (US)

( * ) Notice: Subject to any disclaimer, the term of this patent is extended or adjusted under 35 U.S.C. 154(b) by 214 days.

(21) Appl. No.: 13/300,296

(22) Filed: Nov. 18, 2011

(65) Prior Publication Data

US 2012/0125220 A1 May 24, 2012

Related U.S. Application Data

(60) Provisional application No. 61/415,272, filed on Nov. 18, 2010.

(51) Int. Cl.
*A63G 21/20* (2006.01)
*E01B 25/16* (2006.01)

(52) U.S. Cl.
USPC ..... 104/113; 104/116; 104/173.1

(58) Field of Classification Search
USPC ..... 104/122, 116, 115, 113, 112, 183, 104/173.1, 173.2, 117, 27, 28, 29, 30, 180, 104/193, 53; 212/89, 87, 83; 414/560; 254/213; 105/149.2
See application file for complete search history.

(56) References Cited

U.S. PATENT DOCUMENTS 1,534,185 A * 4/1925 Miller ..... 37/195
1,719,598 A * 7/1929 Dickinson ..... 212/89
2,135,244 A * 11/1938 Uyehara ..... 414/560
3,172,544 A * 3/1965 Johnson et al. ..... 212/89
3,311,243 A * 3/1967 Bachmann ..... 212/87
3,369,673 A * 2/1968 Mosher ..... 212/71
3,674,111 A * 7/1972 Weissberg ..... 182/72
3,713,547 A * 1/1973 Beck ..... 414/22.52
4,053,063 A * 10/1977 Harper, Jr. ..... 414/22.52
4,212,576 A * 7/1980 George ..... 414/22.52
4,473,160 A * 9/1984 Neuenschwander ..... 212/116
5,660,113 A * 8/1997 Lehotsky ..... 104/113
7,381,137 B2 * 6/2008 Steele et al. ..... 472/45
7,699,140 B2 4/2010 Beggrow et al.
2004/0198502 A1 10/2004 Richardson
2008/0260508 A1 10/2008 Olson et al.
2009/0266267 A1 10/2009 Moss

OTHER PUBLICATIONS

PCT/US2011/061488 International Search Report and Written Opinion mailed May 23, 2012.

* cited by examiner

*Primary Examiner* — Mark Le
(74) *Attorney, Agent, or Firm* — Kunzler Law Group, PC

(57) ABSTRACT

An amusement ride apparatus includes a suspended cable and a carriage that supports a user. The carriage is supported on and movable along the suspended cable. Additionally, the apparatus includes a load/unload mechanism that includes a tethering portion and a retractor. The tethering portion is removably coupleable to at least one of the suspended cable and carriage. The retractor is selectively operable in a first mode to retract the tethering portion when removably coupled to the at least one of the suspended cable and carriage to lower the carriage relative to the platform from a raised position to a lowered position and in a second mode to extend the tethering portion when removably coupled to the at least one of the suspended cable and carriage to raise the carriage relative to the platform from the lowered position to the raised position.

19 Claims, 5 Drawing Sheets

AMUSEMENT RIDE LOAD AND UNLOAD METHOD AND ASSOCIATED APPARATUS

CROSS-REFERENCE TO RELATED APPLICATION

This application claims the benefit of U.S. Provisional Patent Application No. 61/415,272, filed on Nov. 18, 2010, which is incorporated herein by reference.

FIELD

The subject matter of this application relates generally to amusement rides, and more particularly to loading passengers on and unloading passengers off of an amusement ride.

BACKGROUND

Amusement rides come in all forms, shapes, and sizes. One conventional type of amusement ride is a zip-line. Typical zip-line amusement rides include a pulley or trolley suspended on a cable that is mounted on an incline. One or more users are secured to the trolley through the use of a safety harness, by manually gripping the trolley, or various other means. Conventionally, users are suspended from the trolley in an upright or partially seated position. The trolley, with a user or users secured thereto, is propelled by gravity downward along the inclined cable.

Zip-line amusement rides typically include braking features to slowly reduce the speed of the trolley as it approaches a user unloading zone, such that the trolley slows to a stop within the user unloading zone. Some braking features include mechanical brakes. Other braking features include introducing sufficient slack to the inclined cable such that the trolley travels slightly upward to slow down the trolley before reaching the end of the cable. After reducing the speed of the trolley upon approach to a user unloading zone, braking features can be configured to completely stop the trolley without user intervention, or require user intervention (e.g., dragging feet or controlled running) in order to bring the trolley to a complete stop.

Regardless of the type of braking features, and whether user intervention is required, the slack and height of the inclined cables of conventional zip-line amusement rides are configured such that the user comes to a stop over a user unloading zone in a position close enough to the ground (e.g., over an unload zone near the end of the cable) to allow the user to step onto the ground, support himself, and easily unload from the ride without vertically lowering the cable or trolley. Because the trolley is significantly slowed down upon approach to the user unloading zone, there is no need to raise the height of the cable to elevate a user's feet above the user unloading zone. Moreover, because the user comes to a stop within the user unloading zone in close proximity to the ground, there is no need to lower the cable or trolley to allow a user to unload from the ride.

SUMMARY

The subject matter of the present application has been developed in response to the present state of the art, and in particular, in response to the problems and needs in the art that have not yet been fully solved by currently available amusement rides and associated methods for loading and unloading users. Accordingly, the subject matter of the present application has been developed to provide various embodiments of an amusement ride that accomplishes user loading and unloading according to a method that overcomes one or more of the above shortcomings of conventional amusement rides.

The amusement ride of the present disclosure includes features for loading and unloading users from an elevated position above a user loading/unloading zone. Generally, in certain embodiments, the amusement ride is a zip-line type amusement ride with a carriage that travels along an inclined cable and passes high over the user loading/unloading zone at a high rate of speed. Braking features then stop and position the carriage at a location relatively high above the user loading/unloading zone.

Because the zip-line amusement ride is specifically configured to allow the carriage to travel over the loading/unloading zone at a high rate of speed, the cable must be placed higher above the loading/unloading zone compared to conventional zip-line amusement rides to prevent user's feet from contacting a loading/unloading zone platform as the carriage travels over the zone. Accordingly, the carriage, and users seated in the carriage, come to a stop higher above the loading/unloading zone compared to conventional zip-line amusement rides. At such an elevated height, the user is unable to safely unload from, and a new user is unable to safely load into, the carriage. Therefore, the present zip-line amusement ride includes a loading/unloading mechanism or apparatus that safely lowers a stopped carriage from a ride conclusion position into a loading/unloading position in closer proximity to the loading/unloading zone platform for safe unloading from the carriage. Additionally, the loading/unloading mechanism raises a newly loaded carriage in the unloading position away from the loading/unloading zone platform into a ride initiation position for safe loading of the carriage.

In certain embodiments, the loading/unloading mechanism includes a retractable coupler or tether coupled to a selectively operable retractor. The retractor is selectively operable between a retraction mode and an extension mode. With the carriage stopped in the ride conclusion position, the retractor is operable in the retraction mode to allow an operator of the ride to freely pull the retractable coupler and attach the coupler to the carriage. The retractor is then operable in the retraction mode to retract the coupler and vertically lower the carriage into the loading/unloading position. From the retraction mode, the retractor is switched into the extension mode to extend the coupler and vertically raise the carriage into the ride initiation position. Accordingly, the loading/unloading mechanism facilitates safe, secure, and efficient loading onto and unloading from a zip-line amusement ride that has a user carriage suspended relatively high above a loading/unloading platform at the conclusion of the ride.

In some embodiments, an amusement ride apparatus includes a suspended cable that extends from a first elevation to a second elevation lower than the first elevation. The apparatus also includes a carriage that supports a user. The carriage is supported on and movable along the suspended cable. The apparatus also includes a platform that is positioned under the suspended cable at the second elevation. The carriage is positioned above the platform when supported by the suspended cable at the second elevation. Additionally, the apparatus includes a load/unload mechanism that includes a tethering portion and a retractor. The tethering portion is removably coupleable to at least one of the suspended cable and carriage. The retractor is selectively operable in a first mode to retract the tethering portion when removably coupled to the at least one of the suspended cable and carriage to lower the carriage relative to the platform from a raised position to a lowered position and in a second mode to extend the tethering portion when removably coupled to the at least one of the suspended cable and carriage to raise the carriage relative to the platform from the lowered position to the raised position.

In some implementations of the apparatus, the carriage includes at least one seat configured to support a user of the ride in a seated position. In the raised position, the feet of a user supported by the user support portion hang above the platform. The carriage can be configured to support at least two users in a side-by-side configuration.

According to some implementations of the apparatus, the load/unload mechanism includes a user interface engageable by a user to switch operation of the load/unload mechanism between the first and second modes. The user interface may include an actuatable switch. Alternatively, or additionally, the user interface may include an actuatable button. The retractor can include a pulley wheel operatively coupled to a motor. The motor can be controllable to rotate the pulley wheel in a first direction in the first mode and rotate the pulley wheel in the second direction in the second mode. Rotation of the pulley wheel in the first direction winds the tethering portion onto the pulley wheel and rotation of the pulley wheel in the second direction unwinds the tethering portion from the pulley wheel.

In certain implementations of the apparatus, in the first mode, the retractor is selectively operable to allow the tethering portion to extend without resistance, and in the second mode, the retractor is configured to extend the tethering portion with resistance. In the first mode, the retractor can also be selectively operable to extend the tethering portion with resistance.

In one implementation of the apparatus, the retractor is positioned below the platform, and the tethering portion is extendable and retractable through an opening formed in the platform. In certain implementations, the tethering portion is removably coupleable to the suspended cable via direct engagement between a coupling element of the tethering portion and the suspended cable. In some implementations, the tethering portion is removably coupleable to the carriage via engagement between a first coupling element of the tethering portion and a second coupling element of the carriage. The first coupling element can be a coupling element selected from the group consisting of hooks, latches, buckles, clasps, fasteners, locks, bolts, and clips, and the second coupling element can be a corresponding coupling element selected from the group consisting of hooks, latches, buckles, clasps, fasteners, locks, bolts, and clips.

According to yet another embodiment, a method for loading users onto and unloading users from an amusement ride is disclosed. The amusement ride includes a suspended cable and user-supporting carriage that is movably supported on the suspended cable. The carriage and users supported on the carriage are positioned in a stationary position elevated above a platform of the amusement ride at a conclusion of the ride. The method includes firstly extending a tether component away from a cable retractor to which the tether component is coupled and removably coupling the extended tether component to at least one of the carriage and suspended cable with the carriage a ride conclusion position. Additionally, the method includes retracting the tether component toward the cable retractor while removably coupled to the at least one of the carriage and suspended cable to lower the carriage relative to the platform from the ride conclusion position to a user loading position. The method also includes secondly extending the tether component away from the cable retractor while removably coupled to the at least one of the carriage and suspended cable to raise the carriage relative to the platform from the user loading position to a ride initiation position.

In some implementations, secondly extending the tether component away from the cable retractor includes resistively extending the tether component via operation of the cable retractor. In yet some implementations, firstly extending the tether component away from the cable retractor includes non-resistively manually extending the tether component away from the cable retractor.

The cable retractor used in the method may include a pulley wheel. As such, firstly and secondly extending the tether portion away from the cable retractor may include unwinding the tether component from the pulley wheel. Moreover, retracting the tether component toward the cable retractor may include winding the tether portion about the pulley wheel.

The pulley wheel can be rotatable via operation of a motor operatively coupled to the pulley wheel. The method may also include switching operation of the motor between (i) a retraction mode to drive rotation of the pulley wheel in a first direction to wind the tether portion about the pulley wheel; and (2) an extension mode to drive rotation of the pulley wheel in a second direction opposite the first direction to unwind the tether portion from the pulley wheel. Firstly extending the tether component away from the cable retractor may include decoupling the pulley wheel from the motor and freely pulling the tether component relative to the pulley wheel to unwind the tether component from the pulley wheel.

According to another embodiment, an apparatus for loading users on and unloading users off of an amusement ride is disclosed. The amusement ride includes a suspended cable and user-supporting carriage movably supported on the suspended cable. The users supported on the carriage are positioned in a stationary position elevated above a platform of the amusement ride at a conclusion of the ride. The apparatus includes a tethering cable that includes a free end and a fixed end. The free end includes a coupling element removably coupleable to the user-supporting carriage. The apparatus also includes a retractor coupled to the platform. The retractor includes a wheel that is operatively driven by a motor. The fixed end of the tethering cable can be fixedly coupled to the wheel.

In a first mode of the apparatus, the tethering cable is windable onto the wheel via driving of the wheel in a first direction by the motor to retract the tethering cable. When the coupling element is removably coupled to the user-supporting carriage, retraction of the tethering cable in the first mode lowers the user-supporting carriage and suspended cable relative to the platform.

In a second mode of the apparatus, the tethering cable is unwindable from the wheel via driving of the wheel in a second direction opposite the first direction by the motor to extend the tethering cable. When the coupling element is removably coupled to the user-supporting carriage, extension of the tethering cable in the second mode resistively raises the user-supporting carriage and suspended cable relative to the platform.

In a third mode of the apparatus, the wheel is operatively decoupled from the motor and the tethering cable is non-resistively unwindable from the wheel for facilitating removable coupling of the coupling element to the user-supporting carriage.

Based on another embodiment, a loading/unloading apparatus includes a user-supporting carriage, which includes a cable mount portion, a user support portion, and a first coupling element. The cable mount portion is connected to the user support portion and the first coupling element is connected to at least one of the cable mount portion and user support portion. The apparatus also includes a suspended cable onto which the cable mount portion movably connects and along which the user-supporting carriage travels. Further, the apparatus includes a driver component, which includes a control box in electronic signal communication with a driver mechanism. The driver mechanism is connected to a pulley device. The apparatus also includes a tether component, which includes a cord and a second coupling element. The cord is fastened to the pulley device and the second coupling element is removably coupleable to at least one of the cable and first coupling element. In addition, the driver component can be set to either a retraction mode or an extension mode.

In some implementations, the loading/unloading apparatus may also include a loading and unloading platform, wherein the driver component is operatively attached to the platform. The user support portion of the carriage may support one or more users and the user support portion of the user-supporting carriage may be a seat, upon which the user(s) may sit for the duration of the ride. The user support portion also may be a hand hold, on which the user(s) may grasp during the duration of the ride. Further, the user support portion may be a harness, within which the user(s) are fastened for the duration of the ride. Also, the first and second coupling elements are mateable pair of one of the following: hooks, latches, buckles, clasps, fasteners, locks, bolts, and clips.

According to one embodiment, a method for loading and unloading users in a zip-line amusement ride includes providing a suspended cable and a user-supporting carriage movably supported on the suspended cable. The carriage is positionable in a stationary position at a conclusion of the ride and includes a cable mount portion connected to a user support portion and a first coupling element, which is connected to at least one of the cable mount portion and user support portion. The method also provides a driver component, which includes a control box in operable connection with a driver mechanism. The driver mechanism is connected with a pulley device. Further, the method includes providing a tethering component, which comprises a cord and a second coupling element. The cord is fastened to the pulley device of the driver component.

The second coupling then attaches to at least one of the cable and first coupling element when the user-supporting carriage is in the stationary position. The tether component then vertically lowers the carriage into a load/unload position before extending the tether component to vertically raise the carriage from the load/unload position back into the stationary position. The method may also provide a loading and unloading platform. The driver component can be operatively attached to the platform. When the driver component is in the extension mode, the tether component can either vertically raise the carriage from the load/unload position by a rapid release of the cord (a first sub-mode of the extension mode), or the tether component vertically can raise the carriage from the load/unload position by a gradual and resistive release of the cord (a second sub-mode of the extension mode).

Reference throughout this specification to features, advantages, or similar language does not imply that all of the features and advantages that may be realized with the present disclosure should be or are in any single embodiment or implementation of the disclosure. Rather, language referring to the features and advantages is understood to mean that a specific feature, advantage, or characteristic described in connection with an embodiment is included in at least one embodiment of the present disclosure. Discussion of the features and advantages, and similar language, throughout this specification may, but do not necessarily, refer to the same embodiment or implementation.

The described features, advantages, and characteristics of the subject matter of the present disclosure may be combined in any suitable manner in one or more embodiments and/or implementations. One skilled in the relevant art will recognize that the subject matter of the disclosure may be practiced without one or more of the specific features or advantages of a particular embodiment or implementation. In other instances, additional features and advantages may be recognized in certain embodiments and/or implementations that may not be present in all embodiments or implementations of the disclosure. These features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present invention, however, absent an express correlation to indicate otherwise, an implementation may be associated with one or more embodiments.

The described features, structures, or characteristics of the subject matter of this disclosure may be combined in any suitable manner in one or more embodiments. In the following description, numerous specific details are provided to impart a thorough understanding of embodiments of the subject matter of the present disclosure. One skilled in the relevant art will recognize, however, that the subject matter disclosed herein may be practiced without one or more of the specific details, or with other methods, components, materials, and so forth. In other instances, well-known structures, materials, or operations are not shown or described in detail to avoid obscuring aspects of the disclosure.

Figure 1:
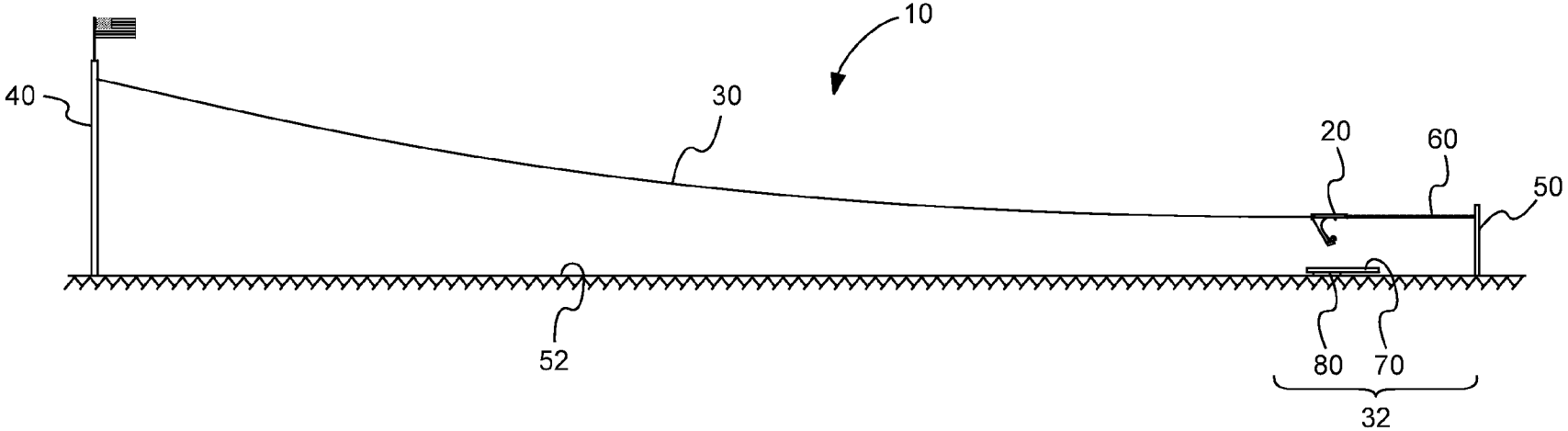
FIG. 1 is a side view of a zip-line amusement ride including a user loading/unloading apparatus according to one representative embodiment.

According to one embodiment shown in FIG. 1, a zip-line amusement ride 10 includes a user-supporting carriage 20 that travels along a cable 30 suspended between a high support 40 and a low support 50. The user-supporting carriage 20 is configured to support at least one user in a seated position. In certain implementations, the carriage 20 includes a seat sufficiently long to support at least two users in a side-by-side configuration. The cable 30 is suspended such that the elevation of the cable gradually decreases from the high support 40 to the beginning of a ride termination zone 32. The ride termination zone 32 is defined as the portion of the cable extending away from the low support 50 that is substantially parallel to the ground 52. The length of the ride termination zone 23 is dependent upon the position of the carriage 20 and varies between a minimum distance when the carriage 20 is positioned at a maximum elevation proximate the high support 40 and a maximum distance when the carriage is stopped over a loading/unloading platform 70. The ride 10 also includes a loading/unloading apparatus 80 operatively coupled with the loading/unloading platform 70. The loading/unloading apparatus 80 facilitates safe, secure, and efficient raising and lowering of the carriage 20 when stopped over the loading/unloading platform 70 as will be described in more detail below.

During operation of the ride 10, the carriage 20, with one or more users secured thereto, is released from a first elevation and propelled by gravity along the cable 30 to a second elevation lower than the first elevation. In certain implementations, the carriage 20 is released at or near a maximum elevation proximate the high support 40 and propelled by gravity along substantially the entire cable until the carriage comes to a stop near the low support 50. The carriage 20 is stopped by a braking mechanism 60. In the illustrated embodiment, the braking mechanism 60 includes a plurality of in-line motion dampeners (e.g., springs) that act to slow the carriage from a maximum speed to a stop with relatively minimal gravitational forces on the user(s). The tension of the cable 30 and configuration (e.g., length) of the braking mechanism 60 promote stoppage of the carriage 20 in a ride conclusion position above a loading/unloading zone defined by the loading/unloading platform 70. In certain embodiments, the carriage 20 is driven (e.g., by a separate driving mechanism (not shown)) from a ride initiation position identical to the ride conclusion position upwardly to the first elevation where the carriage is released. The carriage 20 transitions from the ride conclusion position to the ride initiation position with the unloading of old users and the loading of new users. More specifically, the carriage 20 is moved out of the ride conclusion position to unload and load users, and then moved back into the ride initiation position, which is the same position as the ride conclusion position.

Figure 2:
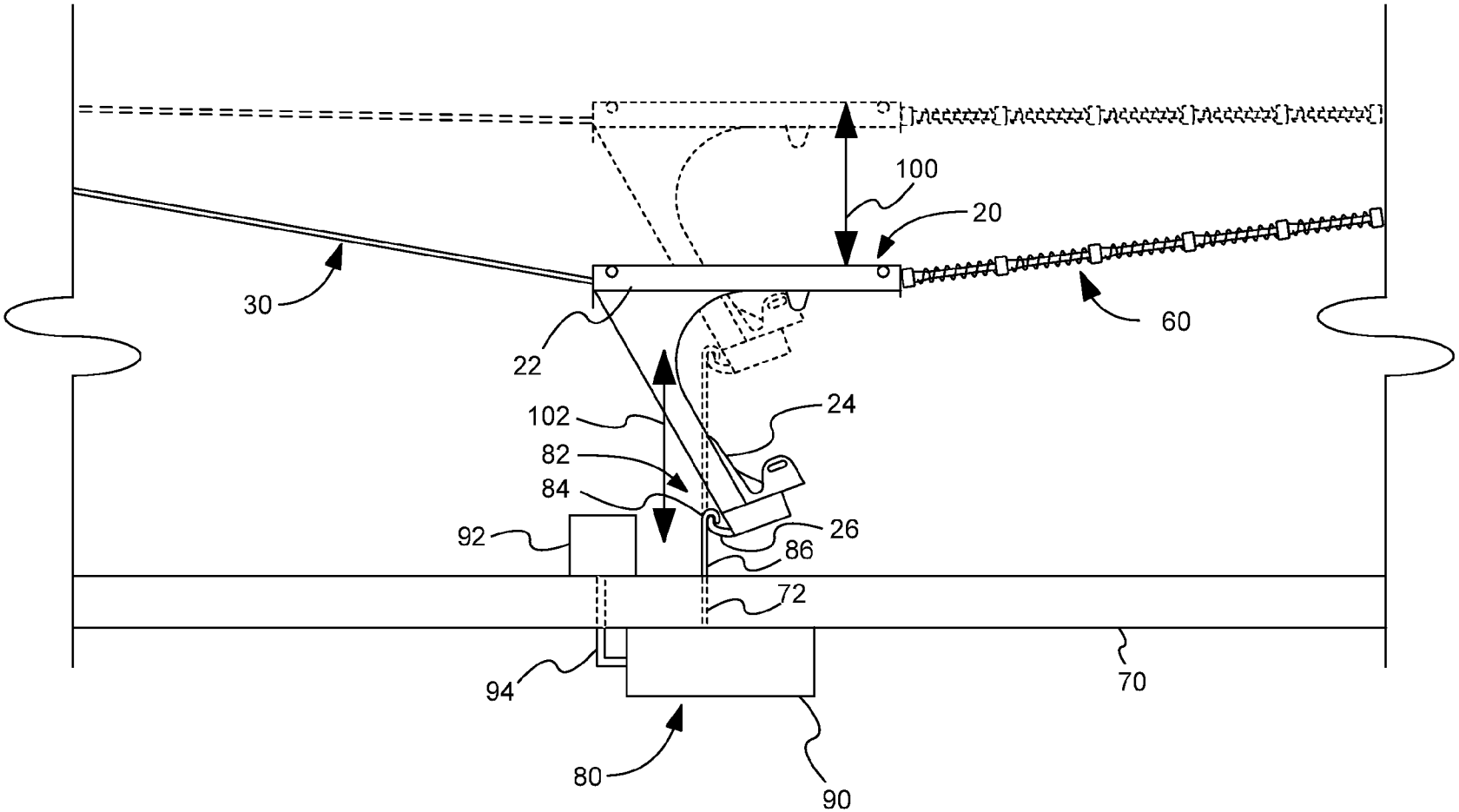
FIG. 2 is a side view of the zip-line amusement ride of FIG. 1 showing the carriage raising and lowering operation of the loading/unloading apparatus according to one embodiment.

Referring to FIG. 2, the loading/unloading apparatus 80 is configured to raise and lower the stopped carriage 20 between a lowered position (solid lines) and a raised position (dashed lines) as indicated by directional arrows 100. The carriage 20 includes a cable mount portion 22 and a user support portion 24. The cable mount portion 22 includes rollers (not shown) that receive and roll along the cable during operation of the ride 10. The user support portion 24 is secured to and extends downward from the cable mount portion 22. The user support portion 24 includes a seat or chair in which one or more user are seated and secured during operation of the ride 10. The carriage 20 also includes a first coupling element 26 securely fixed to either the user support portion 24 or the cable mount portion 22.

The loading/unloading apparatus 80 includes a tether component 82 movably coupled to a retractor or driver 90. The tether component 82 includes a second coupling element 84 secured to a cord or cable 86. The retractor 90 is selectively operable to retract and extend the second coupling element 84 and cable 86 between a retracted position (solid lines) and an extended position (dashed lines) as indicated by directional arrows 102. The platform 70 may include an opening 72 through which the cable 86 extends during operation. The first coupling element 26 and second coupling element 84 of the tether component 82 are configured to removably engage each other. For example, in the illustrated embodiment, the first coupling element 26 is an elongate and curved rod with opposing ends each fixed to the user support portion, and the second coupling element 84 is a hook that grasps the curved rod to removably secure the hook to the first coupling element. In other embodiments, the first coupling element 26 and the second coupling element 84 can be any of various removably mateable coupling arrangements known in the art, such as, for example, latches, buckles, clasps, fasteners, locks, bolts, clips, and the like.

With the second coupling element 84 of the tether component 82 removably secured to the first coupling element 26 on the carriage 20, the retractor 90 is selectively operable to vertically lower and raise the carriage as shown in FIG. 2. Selective operation of the retractor 90 is facilitated by a control box 92 in electronic signal communication with the retractor via a communication line 94. The control box 92 includes a user interface that is accessible by an operator to switch operation of the retractor 90 between a retraction mode and an extension mode. The user interface can be positioned proximate the upper surface of the platform to be accessible by the foot of the operator. Alternatively, or additionally, the user interface can be elevated above the upper surface of the platform to be accessible by the hands of the operator.

In the retraction mode, the retractor 90 is operable to retract or draw the tether component 82 into the retractor such that the length of the tether component 82 above the platform 70 decreases. Additionally, when the retractor 90 is in the retraction mode, the operator is able to manually extend or pull the tether component 82 out from the retractor without substantial resistance. Alternatively, in certain implementations, operation of the retractor 90 can include a release mode, and the ability to manually extend the tether component 82 out from the retractor requires switching to the release mode from either the retraction or extension mode. In the extension mode, the retractor 90 resistively extends the tether component 82 out from the retractor 90 to increase the length of the tether component 82 above the platform.

Figure 3:
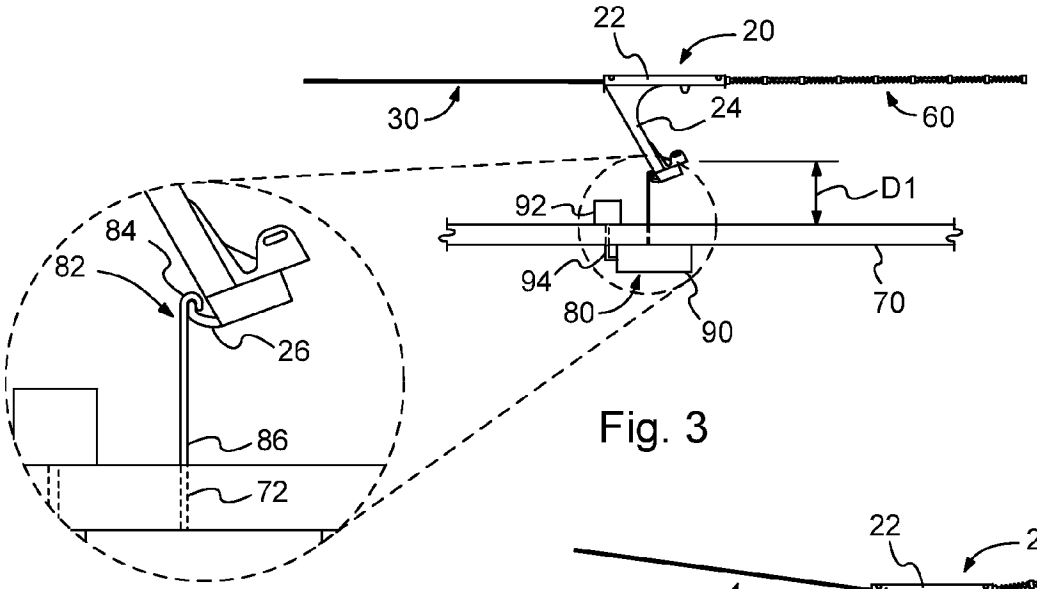
FIG. 3 is a side view of the zip-line amusement ride of FIG. 1 showing the carriage in a raised position according to one embodiment.

Referring to FIG. 3, the carriage 20 is shown in a stopped position (e.g., one of the ride conclusion and initiation positions depending on whether the ride has just concluded or is initiating) relatively high above the platform 70. Further, in this position, the carriage 20 is vertically unbiased such that the cable 30 is oriented substantially parallel to the platform 70. As defined in FIG. 3, the carriage 20 is elevated above the platform 70 by a distance D1, which in certain implementations, can be about five feet. For exemplary purposes, it will be assumed that the carriage 20 in FIG. 3 is in the ride conclusion position. Because of the configuration of the ride 10, users supported by and secured to the user support portion or seat 24 are positioned well above the platform 70 such that the users' feet hang above the platform (which in some cases can be several feet or more). In this position, the users would be unable to properly and safely exit the carriage 20. Therefore, with the retractor 90 in the retraction mode (or, alternatively, in the release mode), a ride unload process is initiated when an operator of the ride 10 manually pulls the tether component 82 to a length above the platform 70 sufficient to removably secure the second coupling element 84 to the first coupling element 26 of the carriage 20. In other words, the operator pulls the tether component 82 until the length of the tether component 82 above the platform 70 is equal to at least the distance D1 and attaches the tether component 82 to the carriage 20.

Figure 4:
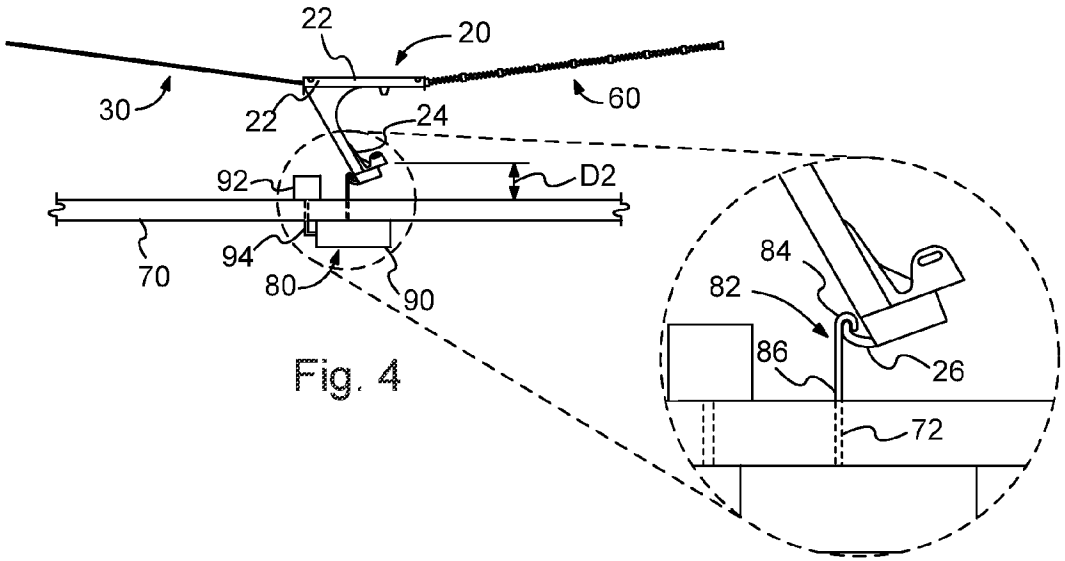
FIG. 4 is a side view of the zip-line amusement ride of FIG. 1 showing the carriage in a lowered position according to one embodiment.

Referring to FIG. 4, with the tether component 82 removably secured to the carriage 20, the operator accesses the control box 92 to retract the tether component 82 into the retractor 90. Accessing the control box 92 may include pushing a button or twisting a knob. As the tether component 82 is retracted, the tether component 82 pulls the carriage 20 toward the platform 70, which vertically lowers the carriage (i.e., decreases the distance between the carriage 20 and the platform), as well as the users' feet relative to the platform. The operator lowers the carriage 20 until the carriage reaches a desirable safe unloading/loading position at a distance D2 above the platform 70, which in certain implementations, can be about twenty-two inches. As the carriage 20 is lowered, the cable 60 is correspondingly bowed as shown in FIG. 4. Generally, the retractor 70 must exert enough pulling force (e.g., torque) to overcome the natural bias of the cable 60, which is at least partially dependent upon the tautness of the cable, to lower the position of the carriage 20. Once in the desirable loading/unloading position, the retractor 90 holds the tether component 82 and the carriage 20 in place while the users, with the assistance of the operator, unload from the carriage by placing their feet on the platform 70.

After the carriage 20 has been unloaded, new users are loaded or reloaded onto the carriage in a loading process while the carriage is in the loading/unloading position. Either before or after the new users are loaded onto the carriage 20, or while the users are loading onto the carriage 20, the operator accesses the control box 92 to switch operation of the retractor 90 from the retraction mode to the extension mode. When the new users are completely loaded, the operator via the control box 92 actuates the retractor 90 to restrictively extend the tether component 82 into an extended position. Extension of the tether component 82 results in the carriage 20 vertically rising (i.e., the distance between the carriage and the platform increases). Generally, the retractor 70 continually applies a resistance force to the tether component 82 to counter the bias of the bowed cable 60. The resistance force applied by the retractor 70 decreases as the tether component 82 is extended and the carriage 20 is raised until the carriage reaches the ride initiation position shown in FIG. 3, at which time the resistance force is negligible.

With the carriage 20 raised into the ride initiation position, the tether component 82 is extended an additional amount sufficient to allow the operator to release the second coupling element 82 of the tether component from the first coupling element 26 of the carriage. Once the tether component 82 is decoupled from the carriage 20, the ride can be initiated (e.g., the carriage 20 can be driven up to the release position as discussed above). If desired, the operator can switch the retractor 90 back into the retraction mode to retract the decoupled tether component 82 before initiating the ride. In this manner, the decoupled tether component 82 is essentially housed within the retractor 90 so as to not interfere with the carriage during operation of the ride.

The retractor 90 can be any device or mechanism configured to retract and extend a tether component with sufficient force to lower and raise a carriage supported by a suspended cable of a zip-line amusement ride. Several arrangements for a retractor are contemplated as part of the subject matter of the present disclosure. For example, the retractor 90 can have any of various parts and be at least one of electrically driven, magnetically driven, pneumatically drive, manually driven, and the like. Accordingly, any of various retractors can be used without departing from the essence of the present disclosure. The retractor 90 has been described herein as being positioned under the platform 70. However, in other implementations, the retractor 90 can be above the platform 70, to the side of the platform, or positioned remotely from the platform.

Figure 5:
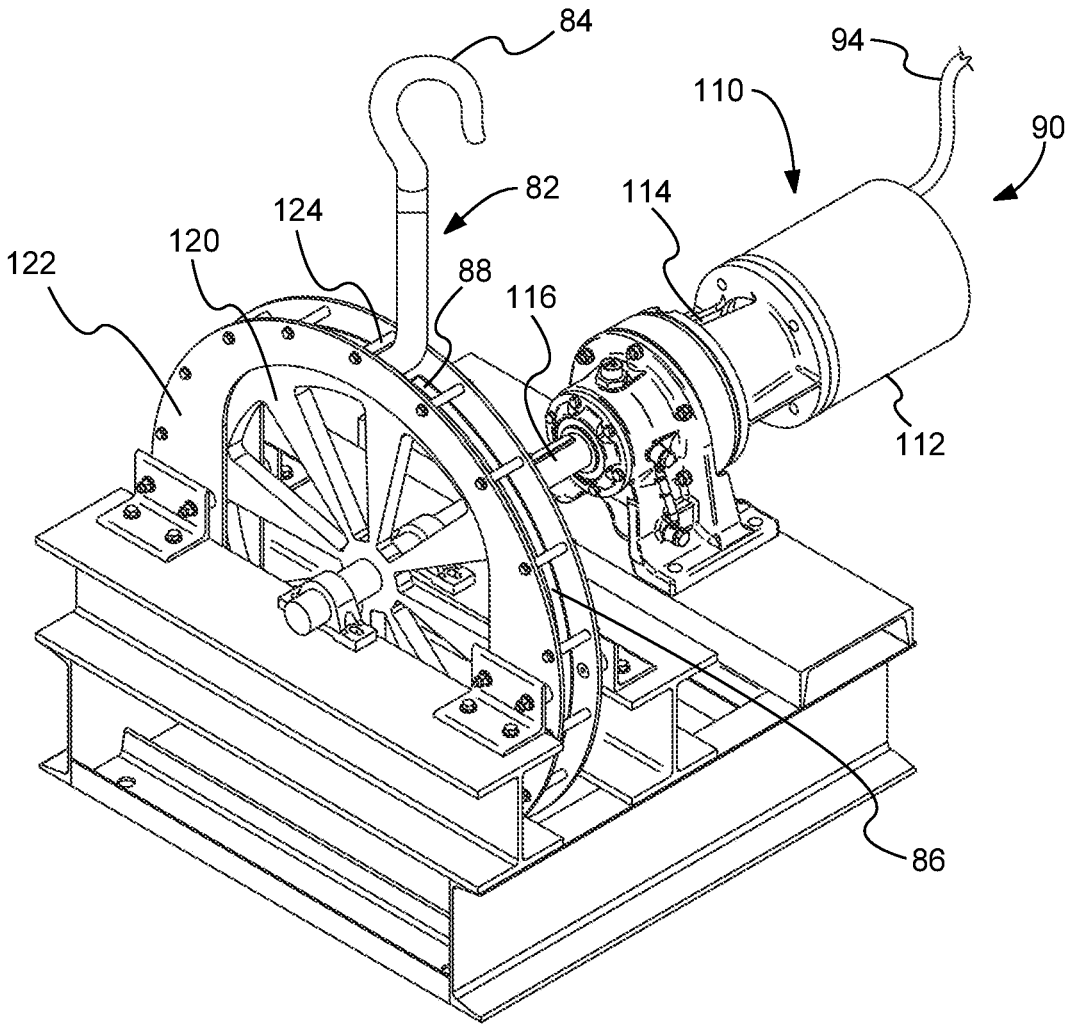
FIG. 5 is a perspective view of a loading/unloading apparatus according to one embodiment.

In one particular embodiment shown in FIG. 5, and for exemplary purposes only, the retractor 90 is an electrically driven retractor that includes a driver 110 selectively operable to drive (e.g., rotate) a pulley or wheel 120. The driver 110 includes an electric motor 112 coupled to a gear reducer 114. The retractor 90 further includes a drive shaft 116 coupled to an output of the gear reducer 114 and the pulley 120. In operation, the driver 110 rotates the drive shaft 116, which correspondingly rotates the pulley 120. One end 88 of the cable 86 of the tether component 82 is secured to a radially outer portion of the pulley 120 such that as the pulley 120 rotates in a first direction, the cable 86 winds about (e.g., encircles) the pulley, and as the pulley rotates in a second direction opposite the first direction, the cable unwinds from the pulley. To facilitate consistent winding onto and unwinding from the pulley 120, the outer periphery of the pulley may have a groove configured to receive and retain the cable 86 while the cable is wound on the pulley. In the illustrated embodiment, the retractor 90 includes a guide 122 with two plates positioned laterally adjacent the pulley 120. The two plates are coupled together and spaced apart via a plurality of stand-off pins 124 positioned between the plates of the guide 122. The guide 122 acts to protect the pulley 120 and prevent the cable 86 from disengaging with the pulley.

In certain implementations, the driver 110 and pulley 120 are specifically sized to ensure the cable 86 of the tether component 82 does not wind upon itself during operation. In other words, the driver 110 and pulley 120 are configured such that the maximum length of the cable 86 wound around the pulley 120 is equal to or less than the outer circumference of the pulley. In this manner, the exact positioning of the cable 86 on the pulley (particularly the location on the pulley where the cable 86 is unwound from the pulley) can be ensured because the cable is not capable of being wound about itself in an at least partially random manner.

Figure 6:
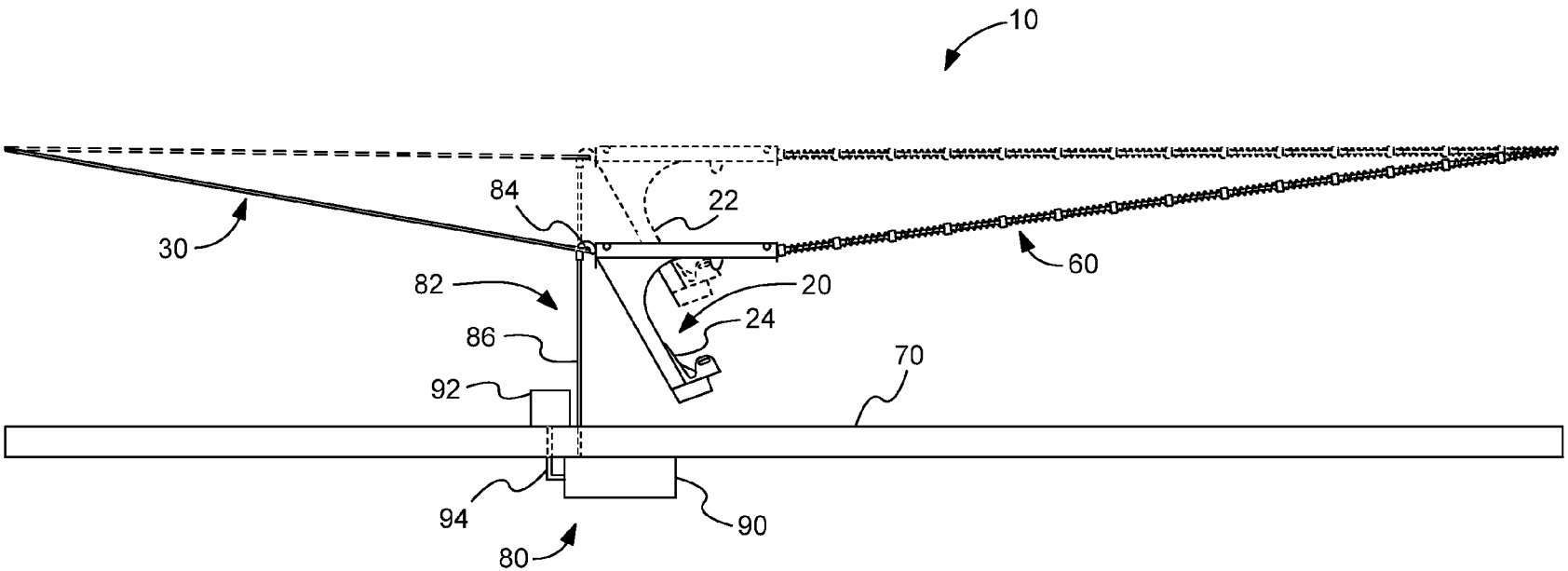
FIG. 6 is a side view of a zip-line amusement ride including a user loading/unloading apparatus that secures the cable of the ride as opposed to the carriage according to one embodiment.

Alternative to the embodiments of the ride 10 described above with regards to FIGS. 3-4, the unload/load apparatus 80 can be configured to lower and raise the carriage 20 by tethering directly to the suspended cable 30 instead of the carriage 20. For example, as illustrated in FIG. 6, the second coupling element 84 of the tether component 82 is attached to the cable 30 instead of a coupling element secured to the carriage 20. As the retractor 90 retracts the tether component 82, the cable 30 is lowered relative to the platform 70. Because the carriage 20 is supported by the cable 30, as the cable is lowered, the carriage 20 is correspondingly lowered. The same application and principle applies to extending the tether component 82 to raise the cable 30 and correspondingly raise the carriage 20.

Additionally, in certain embodiments, the carriage may be configured to support a user in a position (e.g., hanging position, superman-like position, etc.) other than a seated position via a harness or similar device. In such embodiments, the carriage, including users supported by the carriage, is still positioned high above the platform in the raised position, thus requiring lowering to allow users to unload from the carriage and load onto the carriage.

The subject matter of the present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An amusement ride apparatus, comprising;

a suspended cable extending from a first elevation to a second elevation lower than the first elevation;

a carriage for supporting a user, the carriage being supported on and movable along the suspended cable;

a platform positioned under the suspended cable at the second elevation, wherein the carriage is positioned above the platform when supported by the suspended cable at the second elevation; and a load/unload mechanism comprising a tethering portion and a retractor having at least two modes of operation, the tethering portion being removably coupleable to at least one of the suspended cable and carriage, and the retractor being selectively operable in the first mode to retract the tethering portion when removably coupled to the at least one of the suspended cable and carriage to lower the carriage relative to the platform from a raised position to a lowered position and in the second mode to extend the tethering portion when removably coupled to the at least one of the suspended cable and carriage to raise the carriage relative to the platform from the lowered position to the raised position.

2. The apparatus of claim 1, wherein the carriage comprises at least one seat configured to support a user of a ride in a seated position.

3. The apparatus of claim 1, wherein the load/unload mechanism comprises a user interface engageable by a user to switch operation of the load/unload mechanism between the first and second modes.

4. The apparatus of claim 3, wherein the user interface comprises an actuatable switch.

5. The apparatus of claim 3, wherein the user interface comprises an actuatable button.

6. The apparatus of claim 3, wherein the retractor comprises a pulley wheel operatively coupled to a motor, the motor being controllable to rotate the pulley wheel in a first direction in the first mode and rotate the pulley wheel in the second direction in the second mode, and wherein rotation of the pulley wheel in the first direction winds the tethering portion onto the pulley wheel and rotation of the pulley wheel in the second direction unwinds the tethering portion from the pulley wheel.

7. The apparatus of claim 1, wherein in the first mode the retractor is selectively operable to allow the tethering portion to extend without resistance, and wherein in the second mode, the retractor is configured to extend the tethering portion with resistance.

8. The apparatus of claim 1, wherein in the first mode, the retractor is selectively operable to extend the tethering portion with resistance.

9. The apparatus of claim 1, wherein the retractor is positioned below the platform, and wherein the tethering portion is extendable and retractable through an opening formed in the platform.

10. The apparatus of claim 1, wherein the carriage is configured to support at least two users in a side-by-side configuration.

11. The apparatus of claim 1, wherein the tethering portion is removably coupleable to the carriage via engagement between a first coupling element of the tethering portion and a second coupling element of the carriage, and wherein the first coupling element comprises a coupling element selected from the group consisting of hooks, latches, buckles, clasps, fasteners, locks, bolts, and clips, and the second coupling element comprises a corresponding coupling element selected from the group consisting of hooks, latches, buckles, clasps, fasteners, locks, bolts, and clips.

12. The apparatus of claim 1, wherein the tethering portion is removably coupleable to the suspended cable via direct engagement between a coupling element of the tethering portion and the suspended cable.

13. A method for loading and unloading in an amusement ride comprising a suspended cable and user-supporting carriage movably supported on the suspended cable, the carriage being positioned in a stationary position elevated above a platform of the amusement ride at a conclusion of the ride, the method comprising:

firstly extending a tether component away from a cable retractor to which the tether component is coupled;

removably coupling the extended tether component to at least one of the carriage and suspended cable with the carriage a ride conclusion position;

retracting the tether component toward the cable retractor while removably coupled to the at least one of the carriage and suspended cable to lower the carriage relative to the platform from the ride conclusion position to a user loading position;

secondly extending the tether component away from the cable retractor while removably coupled to the at least one of the carriage and suspended cable to raise the carriage relative to the platform from the user loading position to a ride initiation position.

14. The method of claim 13, wherein secondly extending the tether component away from the cable retractor comprises resistively extending the tether component via operation of the cable retractor.

15. The method of claim 13, wherein firstly extending the tether component away from the cable retractor comprises non-resistively manually extending the tether component away from the cable retractor.

16. The method of claim 13, wherein the cable retractor comprises a pulley wheel, wherein firstly and secondly extending the tether portion away from the cable retractor comprises unwinding the tether component from the pulley wheel, and retracting the tether component toward the cable retractor comprises winding the tether portion about the pulley wheel.

17. The method of claim 16, wherein the pulley wheel is rotatable via operation of a motor operatively coupled to the pulley wheel, the method further comprising switching operation of the motor between a retraction mode to drive rotation of the pulley wheel in a first direction to wind the tether portion about the pulley wheel and an extension mode to drive rotation of the pulley wheel in a second direction opposite the first direction to unwind the tether portion from the pulley wheel.

18. The method of claim 17, wherein firstly extending the tether component away from the cable retractor comprises decoupling the pulley wheel from the motor and freely pulling the tether component relative to the pulley wheel to unwind the tether component from the pulley wheel.

19. An apparatus for loading and unloading in an amusement ride comprising a suspended cable and user-supporting carriage movably supported on the suspended cable, the carriage being positioned in a stationary position elevated above a platform of the amusement ride at a conclusion of the ride, the apparatus comprising:

a tethering cable comprising a free end and a fixed end, the free end comprising a coupling element removably coupleable to the user-supporting carriage; and a retractor coupled to the platform, the retractor having three modes of operation and comprising a wheel operatively driven by a motor, wherein the fixed end of the tethering cable is fixedly coupled to the wheel;

wherein in the first mode, the tethering cable is windable onto the wheel via driving of the wheel in a first direction by the motor to retract the tethering cable, and wherein when the coupling element is removably coupled to the user-supporting carriage, retraction of the tethering cable in the first mode lowers the user-supporting carriage and suspended cable relative to the platform;

wherein in the second mode, the tethering cable is unwindable from the wheel via driving of the wheel in a second direction opposite the first direction by the motor to extend the tethering cable, and wherein when the coupling element is removably coupled to the user-supporting carriage, extension of the tethering cable in the second mode resistively raises the user-supporting carriage and suspended cable relative to the platform; and wherein in the third mode, the wheel is operatively decoupled from the motor and the tethering cable is non-resistively unwindable from the wheel for facilitating removable coupling of the coupling element to the user-supporting carriage.

* * * * *